US008066796B1

(12) United States Patent
Gustafson et al.

(10) Patent No.: US 8,066,796 B1
(45) Date of Patent: Nov. 29, 2011

(54) PROCESS TO CREATE SIMULATED LUNAR AGGLUTINATE PARTICLES

(75) Inventors: Robert J. Gustafson, Cross Plains, WI (US); Marty A. Gustafson, Cross Plains, WI (US); Brant C. White, Madison, WI (US)

(73) Assignee: Orbital Technologies Corporation, Madison, WI (US)

( * ) Notice: Subject to any disclaimer, the term of this patent is extended or adjusted under 35 U.S.C. 154(b) by 535 days.

(21) Appl. No.: 12/017,681

(22) Filed: Jan. 22, 2008

Related U.S. Application Data

(60) Provisional application No. 60/885,934, filed on Jan. 22, 2007.

(51) Int. Cl.
*B22F 9/04* (2006.01)

(52) U.S. Cl. ..... 75/345; 148/99; 148/512

(58) Field of Classification Search ..... 75/345; 148/512

See application file for complete search history.

(56) References Cited

U.S. PATENT DOCUMENTS

| | | | | | |
|---|---|---|---|---|---|
| 3,693,731 | A * | 9/1972 | Armstrong et al. | ..... | 175/11 |
| 3,788,703 | A * | 1/1974 | Thorpe | ..... | 299/14 |
| 3,856,899 | A * | 12/1974 | Schott | ..... | 264/8 |
| 5,827,012 | A * | 10/1998 | Circeo, Jr. | ..... | 405/131 |
| 2007/0049487 | A1* | 3/2007 | Guenther et al. | ..... | 501/155 |
| 2008/0003133 | A1* | 1/2008 | Taylor et al. | ..... | 422/21 |

OTHER PUBLICATIONS

Weiblen, Paul et al., "Preparation of Simulants for Lunar Surface Materials", Engineering, Construction and Operations in Space II, ASCE Space 1990, pp. 98-106.

Buono, Antonio et al., "Experimental Production of Pure Ion Globules from melts of Lunar Soil Compositions", Lunar and Planetary Science XXXVI, Abstract No. 2066, Lunar and Planetary Institute, 2 pp., 2005.

Liu, Y., Taylor, L., Thompson, J., Hill, E., Day, J., "Simulation of Nanophase Iron in Lunar Soil for Use in ISRU Studies", Meteoritical & Planetary Science, 40 Suppl. A94, 2005, 1 p.

Liu, Y., Taylor, L., Thompson, J.R., Patchen, A., Hill, E., Park, J., "Lunar Agglutinitic Glass Stimulants with Nanophase Iron", Abstract 2077 and Poster Presentation at Space Resources Roundtable VII: LEAG Conference, Lunar & Planetary Institute, LPI Contribution No. 1318, 1 p., 2005.

Basu et al. "Occurrence and Distribution of $Fe^0$-Globules in Lunar Agglutinates" *Lunar and Planetary Science XXXII*2001. 2 pages.

McKay et al. "Chapter 7: The Lunar Regolith" from the *Lunar Sourcebook: a user's guide to the moon*. Heiken et al. (eds.) Cambridge University Press 1991:285-302.

Gustafson et al. "Development of a Lunar Agglutinate Simulant" Space Roundtable VIII, Golden, Colorado, Oct. 31-Nov. 2, 2006. PowerPoint Presentation. 16 pages.

Gustafson et al. "Development of a Lunar Agglutinate Simulant" 2006, 2 pages.

* cited by examiner

*Primary Examiner* — George Wyszomierski
(74) *Attorney, Agent, or Firm* — Dorsey & Whitney LLP

(57) ABSTRACT

A method of creating simulated agglutinate particles by applying a heat source sufficient to partially melt a raw material is provided. The raw material is preferably any lunar soil simulant, crushed mineral, mixture of crushed minerals, or similar material, and the heat source creates localized heating of the raw material.

6 Claims, 4 Drawing Sheets

PROCESS TO CREATE SIMULATED LUNAR AGGLUTINATE PARTICLES

CROSS-REFERENCE TO RELATED APPLICATION(S)

This application claims priority to Provisional Patent Application No. 60/885,934, filed Jan. 22, 2007, the contents of which are incorporated in their entirety herein by reference.

GOVERNMENT SUPPORT

This invention was made with Government support under contract NNM06AA76C awarded by the National Aeronautics and Space Administration (NASA). The Government has certain rights in this invention.

BACKGROUND OF THE INVENTION

1. Field of the Art

The present invention relates to a process of creating simulated agglutinates. Agglutinates are individual particles that are aggregates of smaller lunar soil particles (mineral grains, glasses, and even older agglutinates) bonded together by vesicular, flow-banded glass. The simulated agglutinates can have many of the properties that are unique to real agglutinates found in the lunar soil, including: (1) a highly irregular shape, (2) heterogeneous composition (due to the presence of individual soil particles), (3) presence of trapped bubbles of solar wind gases (primarily hydrogen) that are released when the agglutinates are crushed, and (4) the presence of very small iron metal droplets or globules (including "nanophase" iron) that often exists in trails or trains on and within the agglutinitic glass.

2. Description of Prior Art

Dr. Paul Weiblen (University of Minnesota) attempted to create simulated agglutinate particles by dropping Minnesota Lunar Simulant (MLS) through a 6000 C plasma torch within an in-flight sustained shockwave plasma reactor. This was a viable method for producing simulants of some glassy components of the lunar soil, but it failed to produce accurate analogs of lunar agglutinates. (Weiblen, Paul, Marian Murawa, and Kenneth Reid. 1990. "Preparation of Simulants for Lunar Surface Materials," *Engineering, Construction and Operations in Space II*, ASCE Space 1990, pp. 98-106.) Researchers at the University of Indiana have reported the formation of iron globules (200 nm to 1 mm in diameter) in a glass matrix that was heated to 1277 C in a hydrogen gas atmosphere for 20 hours. (Buono, Antonio, James Brophy, Juergen Schieber, Abhijit Basu. 2005 "Experimental Production of Pure Iron Globules from Melts of Lunar Soil-Compositions," in *Lunar and Planetary Science XXXVI*, Abstract No. 2066, Lunar and Planetary Institute.) Researchers at the University of Tennessee have reported a similar method to create an agglutinitic glass simulant that contains "nanophase" iron particles (defined as metallic iron particles with a diameter of less than 50 nanometers). (Lui, Yang, Larry Taylor, James Thompson, Eddy Hill, and James Day. 2005. "Simulation of Nanophase $Fe^0$ in Lunar Soil for Use in ISRU Studies," in *Meteoritical & Planetary Science,* 40 suppl. A 94.) (Y. Liu, L. A. Taylor, J. R. Thompson, A. Patchen, E. Hill, J. Park. 2005. "Lunar Agglutinitic Glass Simulants with Nanophase Iron," Abstract #2077 and Poster Presentation at *Space Resources Roundtable VII: LEAG Conference*, Lunar & Planetary Institute, *LPI Contribution No.* 1318.) Other researchers at the Laurentian University have reported the use of a vapor deposition technique to create nanophase iron surface deposits. (Mercier, Louis, Luc Beaudet, and Roger Pitre. 2006. "Formation of Nanophase Iron Inside Mesoporous Silica Frameworks: Novel Preparation Strategies for Optimized Synthetic Lunar Regolith Formulations," Technical Paper 5-5 at the *Planetary & Terrestrial Mining Sciences Symposium*, Sudbury, Ontario.) All of these researchers succeeded in creating simulated agglutinitic glass with some degree of fidelity, but none of them created simulated agglutinate particles that have the same size, highly irregular shape, heterogeneous composition, and vesicular glass exhibited in lunar agglutinates.

SUMMARY OF THE INVENTION

Agglutinates make up a high proportion of lunar soils, about 50% wt on average (ranges from 5% wt to about 65% wt). However, current lunar soil simulants (e.g., JSC-1, MLS-1a, FSC-1) do not contain any particles that accurately simulate the mechanical behavior or composition of agglutinates. The present invention is a process to create simulated agglutinate particles from virtually any lunar soil simulant or similar material.

The unique properties of lunar agglutinates significantly affect the mechanical behavior and other thermo-physical properties of lunar soil. For example, agglutinates tend to interlock and produce unusually high shear strength compared to current lunar soil simulants. Lunar soil is more compressible than current lunar soil simulant due to the crushing of agglutinates under load. Unlike current lunar soil simulants, the mechanical properties of lunar soil will change due to its previous loading history. Agglutinates also contain a significant amount of metallic iron (including iron globules and nanophase iron) which is not found in current lunar soil simulants. The presence of the iron globules and nanophase iron affect the behavior of the lunar soil simulant, including its magnetic susceptibility and the absorption of microwave energy.

The present invention provides a method of creating simulated agglutinate particles from any lunar soil simulant, crushed mineral, mixture of crushed mineral, or other similar raw material. The process involves localized heating of the raw material to cause partial melting. When the molten material cools, it forms a glass that cements grains of the unmelted raw material together, forming simulated agglutinate particles with the same general size and shape as lunar agglutinates. If the raw material contains iron oxide-bearing minerals, this process can be performed in the presence of hydrogen gas. The iron oxide-bearing minerals in the molten material are partially reduced by the hydrogen gas and create small metallic iron globules and nanophase iron. The size of the iron globules is determined by the heating time, but they can be as small as a few nanometers in diameter. The metallic iron globules are trapped on the surface and within the glassy portion of the resulting simulated agglutinate particle, similar to lunar agglutinates.

DESCRIPTION OF THE PREFERRED EMBODIMENT

The present invention provides a process of creating simulated agglutinate particles from any lunar soil simulant or similar raw material. Lunar soil simulants (e.g., JSC-1, MLS-1a, FSC-1) generally have particle sizes below 1 mm and contain some iron oxide-bearing minerals. In one embodiment, the presence of iron oxide-bearing minerals is required to create the small iron globules in the glassy portion of each simulated agglutinate particle.

Figure 1:
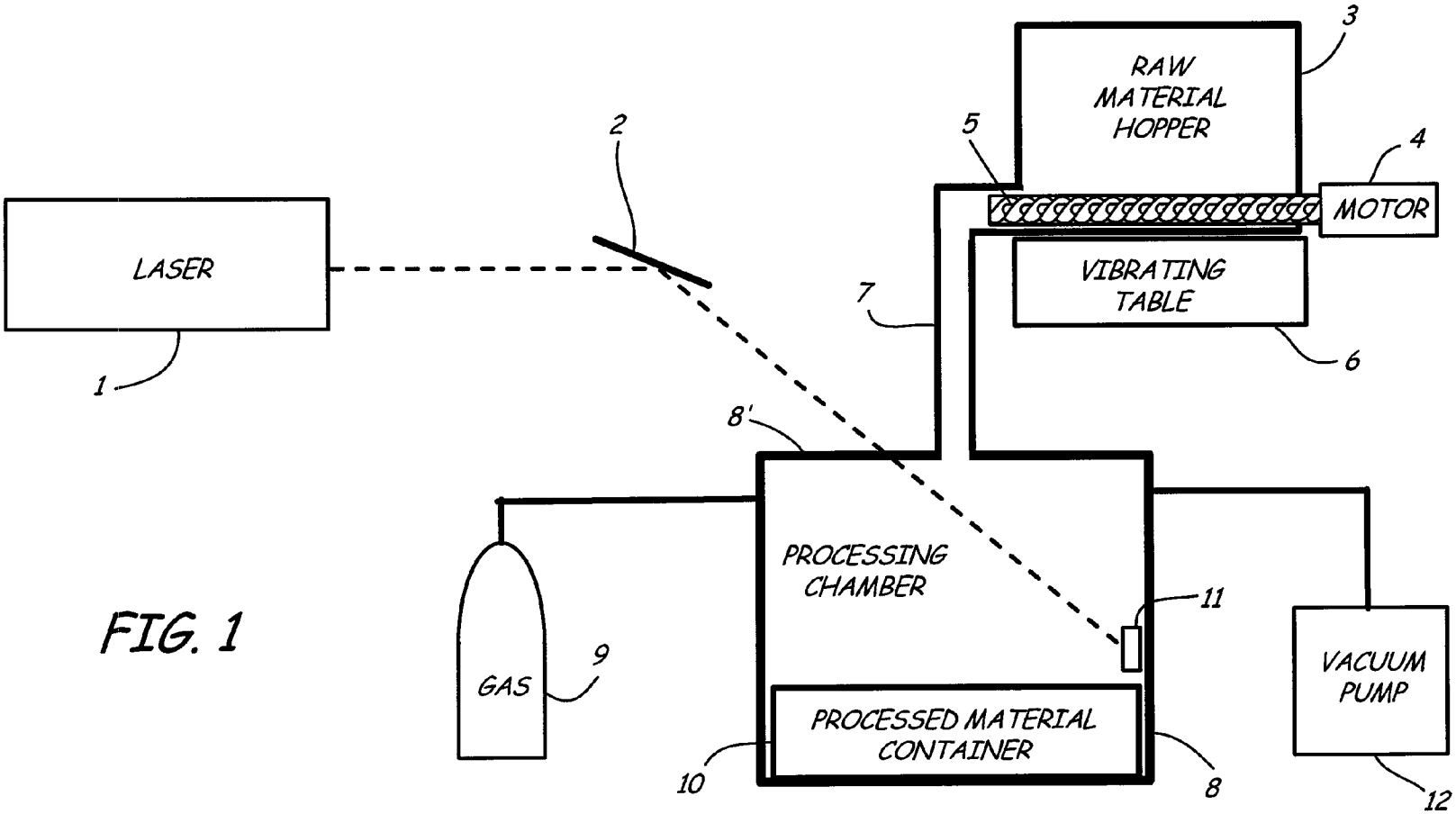
FIG. 1 illustrates an embodiment of a process of creating simulated agglutinate particles from any lunar soil simulant or similar raw material, which includes major components of processing hardware to drop raw material through a continuous laser beam, in accordance with the principles of the present invention.

The major components of the processing hardware used to create simulated agglutinate particles are shown in FIG. 1, including a $CO_2$ laser 1, laser minor 2, raw material hopper 3, transfer auger 5 and electric drive motor 4, vibrating table 6, vertical drop tube 7, processing chamber 8, hydrogen gas supply 9, processed material container 10, laser beam stop 11, and vacuum pump 12. Note that the raw material hopper 3 and the processing chamber 8 are connected by the vertical drop tube 7. The process generally includes the following steps:

Step 1—The raw material is placed inside the raw material hopper 3. The raw material hopper is then closed. The internal volume of the raw material hopper 3, vertical drop tube 7, and processing chamber 8 is then evacuated with the vacuum pump 12. The evacuated volume is then filled with hydrogen gas from the hydrogen gas supply 9. Alternatively, the internal volume can be purged with hydrogen gas if the vacuum pump 12 is not used. If the production of iron globules is not desired, this process can be performed in any other gas at any pressure, or under vacuum conditions.

Step 2—The electric drive motor 4 rotates the transfer auger 5 to move the raw material from the raw material hopper 3 to the top of the vertical drop tube 7. The assembly of the raw material hopper, the electric drive motor 4, and the transfer auger 5 is vibrated by the vibrating table 6 to fluidize the raw material and aid in its transfer. It is appreciated that the system can be operated without the vibrating table 6, if desired. The rate at which the raw material is transferred into the vertical drop tube 7 is proportional to the rotation rate of the transfer auger 5. Once the raw material enters the top of the vertical drop tube 7, it falls down the vertical drop tube 7 into the processing chamber 8 where it passes through a continuous laser energy beam produced by the $CO_2$ laser 1. The laser energy emitted from the $CO_2$ laser 1 reflects off of the $CO_2$ laser mirror 2 down into the processing chamber 8 through a window 8' that is transparent to the laser energy (e.g., zinc selenide). As the raw material falls through the laser energy beam, the raw material absorbs the laser energy which causes very rapid heating and localized melting of the raw material. Note that the laser power flux (power per unit area) must be high enough to heat and partially melt some of the raw material that is falling through the laser beam. Any laser energy that is not absorbed by the raw material is absorbed by the laser beam stop 11. After the heated material falls below the laser energy beam, the molten material quickly cools and forms a glass that cements the surrounding unmelted material grains together into a simulated agglutinate particle. The processed material is collected in the processed material container 10 located at the bottom of the processing chamber 8. If this process is performed in a hydrogen gas atmosphere, the hydrogen reduces some of the iron oxide-bearing minerals in the molten material and forms numerous small metallic iron globules and nanophase iron, along with vesicles (bubbles).

Step 3—After the processing is complete, the internal volume of the raw material hopper 3, vertical drop tube 7, and processing chamber 8 is evacuated with the vacuum pump 12. The evacuated volume is then filled with an inert gas or air. The processing chamber 8 is then opened and the processed material container 10 is removed. The simulated agglutinate particles may be separated from any raw material in the processed material container 10 using a simple sieving technique, if required, since the simulated agglutinate particles are larger than the initial raw material. Alternatively, the simulated agglutinate particles can remain mixed with the raw material that was not melted by the laser. The proportion of simulated agglutinate particles in the processed material can be controlled by adjusting the feed rate of the raw material, the overall laser beam power (e.g., W), and the laser beam power flux (e.g., $W/cm^2$). The amount and size distribution of the metallic iron globules formed can be controlled by adjusting the hydrogen gas pressure, the processing temperature, and the processing time. The processing temperature is determined by the laser beam power flux, while the processing time is determined by the laser beam diameter.

DESCRIPTION OF ALTERNATIVE EMBODIMENTS

There are several variations of this process for creating simulated agglutinate particles that have been reduced to practice. Some examples of these alternate embodiments are described below.

Example 1

Figure 2:
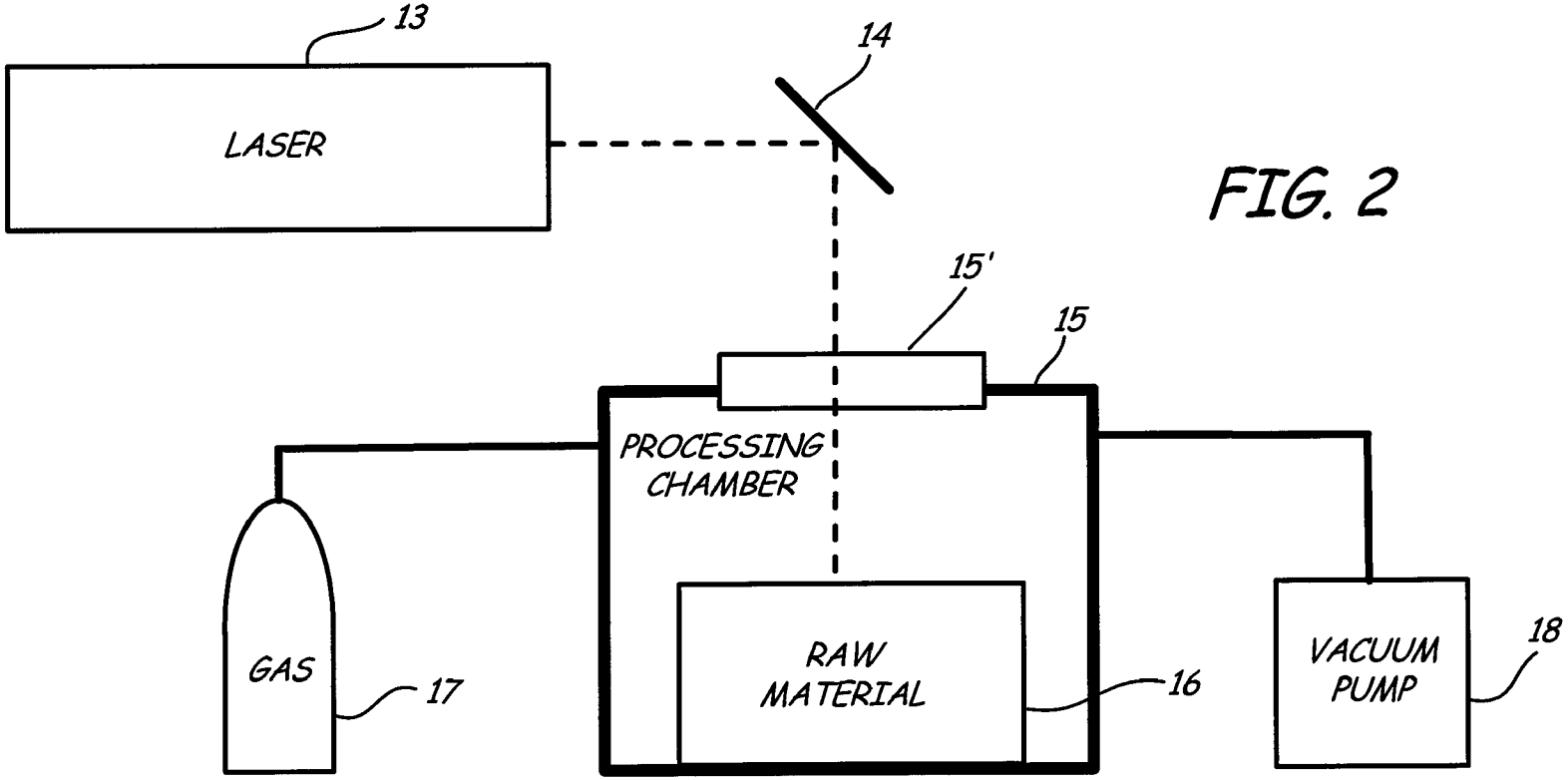
FIG. 2 illustrates an alternative embodiment of a process of creating simulated agglutinate particles from any lunar soil simulant or similar raw material, which includes major components of processing hardware to use moving laser pulses on the raw material, in accordance with the principles of the present invention.
Figure 3:
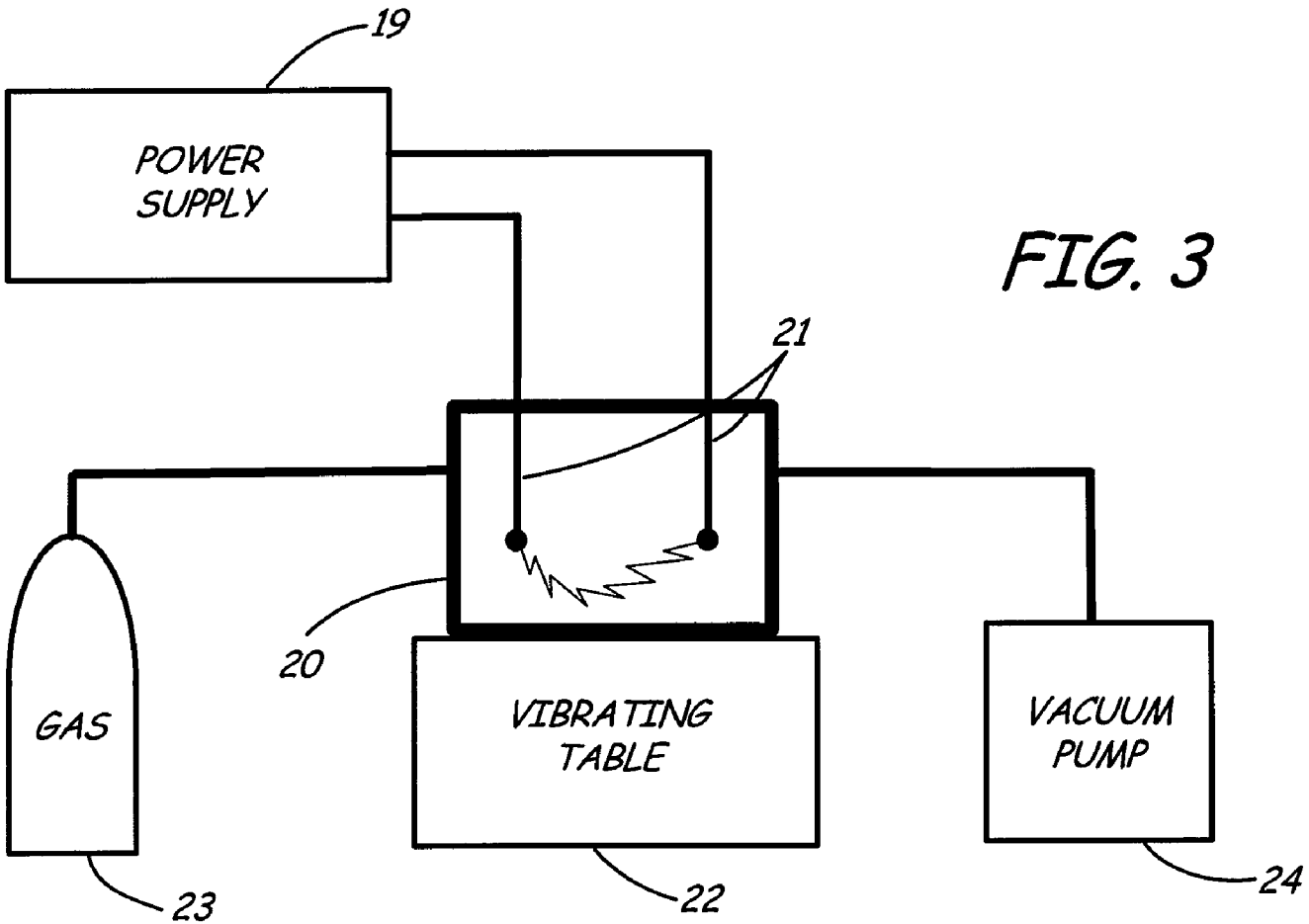
FIG. 3 illustrates a second alternative embodiment of a process of creating simulated agglutinate particles from any lunar soil simulant or similar raw material, which includes major components of processing hardware to move raw material through an electric arc, in accordance with the principles of the present invention.
Figure 4:
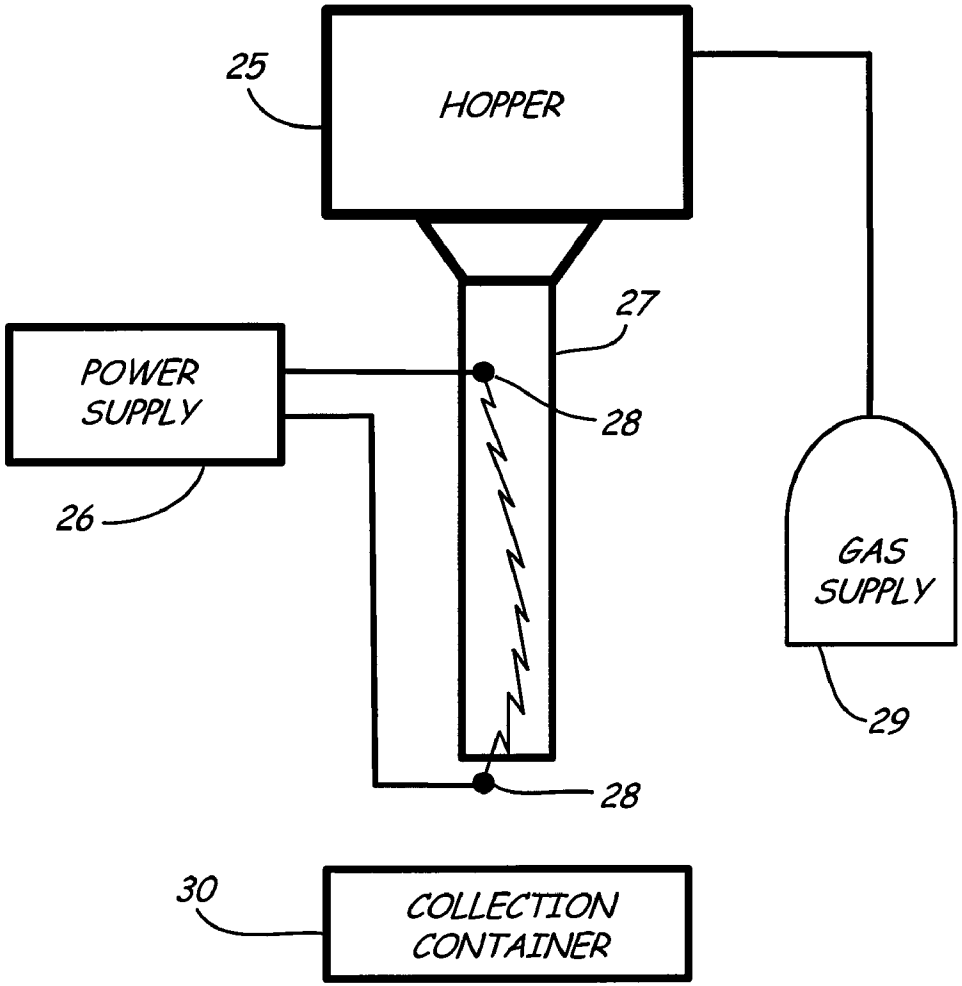
FIG. 4 illustrates a third alternative embodiment of a process of creating simulated agglutinate particles from any lunar soil simulant or similar raw material, which includes major components of processing hardware to drop raw material through an electric arc, in accordance with the principles of the present invention.

In this example, the major components of the processing hardware used to create simulated agglutinate particles are shown in FIG. 2, including a $CO_2$ laser 13, motorized laser mirror 14, processing chamber 15, material container 16, hydrogen gas supply 17 and vacuum pump 18. The raw material is placed inside the processing chamber 15 in the material container 16. The processing chamber 15 is closed and evacuated with the vacuum pump 18. The processing chamber 15 is then filled with hydrogen gas from the hydrogen gas supply 7. Alternatively, the processing chamber 15 can be purged with hydrogen gas if the vacuum pump is not used. If the production of iron globules is not desired, this process can be performed in any other gas at any pressure, or under vacuum conditions. The raw material is exposed to a pulse of $CO_2$ laser energy. The laser energy emitted from the $CO_2$ laser 13 reflects off of the motorized laser mirror 14 down into the processing chamber 15 through a window 15' that is transparent to the laser energy (e.g., zinc selenide). The laser pulse causes very rapid heating and localized melting of the raw material. Note that the laser power flux (power per unit area) must be high enough and the laser pulse duration long enough to heat and partially melt some of the raw material that is exposed. After the laser pulse ends, the molten material quickly cools and forms a glass that cements the surrounding unmelted material grains together into a simulated agglutinate particle. If this process is performed in a hydrogen gas atmosphere, the hydrogen reduces some of the iron oxide-bearing minerals in the molten material and forms small metallic iron globules and nanophase iron, along with vesicles (bubbles). The motorized laser mirror 14 is then moved slightly to change the location where the laser energy is incident on the raw material. Step 2 is then repeated at this location. Steps 2 and 3 are repeated as needed to create simulated agglutinate particles over the surface of the raw material.

Example 2

In this example, the same basic configuration shown in FIG. 2 is used. However, the motorized laser mirror 14 is replaced with a stationary laser mirror or the laser energy is directly admitted into the processing chamber 15. The material container 16 is placed on a vibrating table (not shown). The vibration agitates the raw material and causes it to move around the material container 16. The raw material is exposed to a series of laser pulses. Each laser pulse creates one or more simulated agglutinate particles which are immediately moved away from the laser beam. Other methods to agitate and move the raw material during laser processing can be used, including mechanical stirring or a rotating drum. Note that if the production of iron globules is not desired, this process can be performed in any other gas or vacuum environment.

Example 3

In this example, the laser is replaced with an electric arc to provide the brief, intense heating that is generally required in the process to create simulated agglutinate particles. The raw material is placed inside a small processing chamber 20. The processing chamber 20 is closed and evacuated with a vacuum pump 24. The processing chamber is then filled with ~1 atmosphere of hydrogen gas from a hydrogen gas supply 23. Alternatively, the processing chamber can be purged with hydrogen gas if the vacuum pump is not used. The processing chamber 20 is attached to a vibrating platform 22. The vibration agitates the raw material and causes it to move around the processing chamber 20. A high voltage power supply 19 creates an electric arc between two electrodes 21 located inside the processing chamber 20. The raw material is partially melted as it passes through the electric arc inside the processing chamber 20, forming the simulated agglutinate particles. Other methods to move the raw material during the electric arc processing can be used, including mechanical stirring or a rotating drum. Note that if the production of iron globules is not desired, this process can be performed in any other gas or vacuum environment.

Example 4

In this example, the raw material is loaded into a hopper assembly 25. Hydrogen gas from a gas supply 29 flows into the hopper assembly 25 and down a vertical processing tube 27. The hopper assembly 25 and the vehicle processing tube 27 are continuously purged with the hydrogen gas. Alternatively, the vehicle processing tube 27 and an open hopper assembly can be placed inside a large pressure vessel that is filled with hydrogen gas. The vehicle processing tube 27 has electrical electrodes 28 located near the top and at the bottom. A high-voltage power supply 26 creates an electric arc between the two electrodes 28. Raw material is fed from the hopper assembly 25 into the vehicle processing tube 27. The raw material is partially melted as is falls through the electric arc inside the vehicle processing tube 27, forming the simulated agglutinate particles. The simulated agglutinate particles cool after they leave the vehicle processing tube 27 and solidify before landing in a collection container 30. It is appreciated that other heating sources, such as a laser, could be used to replace the electric arc in this configuration to provide the localized heating required to form the simulated agglutinate particles.

From the above description and drawings, it will be understood by those of ordinary skill in the art that the particular embodiments shown and described are for purposes of illustration only and are not intended to limit the scope of the present invention. Those of ordinary skill in the art will recognize that the present invention may be embodied in other specific forms without departing from its spirit or essential characteristics. References to details of particular embodiments are not intended to limit the scope of the invention.

What is claimed is:

1. A method of creating simulated agglutinate particles, comprising:

providing a raw material;

applying a localized heat source that creates localized heating of the raw material to partially melt the raw material; and forming irregular shaped simulated agglutinate particles wherein the raw material is stationary, and the heat source is moved once or repeatedly through the raw material.

2. A method of creating simulated agglutinate particles, comprising:

providing a raw material;

applying a localized heat source that creates localized heating of the raw material to partially melt the raw material; and forming irregular shaped simulated agglutinate particles, wherein both the raw material and the heating source are moving.

3. A method of creating simulated agglutinate particles, comprising:

providing a raw material;

applying a localized heat source that creates localized heating of the raw material to partially melt the raw material; and forming irregular shaped simulated agglutinate particles, wherein the raw material comprises iron oxide and is processed in presence of hydrogen to produce metallic iron globules and nanophase iron in resulting glassy portion of each simulated agglutinate particle.

4. A method of creating simulated lunar agglutinate particles, comprising:

providing a raw material, wherein the raw material is at least one of a lunar soil simulant, crushed mineral or mixture of crushed minerals, and wherein the raw material comprises iron oxide bearing minerals;

applying a heat source to partially melt the raw material;

processing the raw material in the presence of hydrogen gas; and forming irregular shaped simulated agglutinate particles comprising iron globules or nanophase iron.

5. The method of claim 4, wherein the heat source is a localized heat source that creates localized heating of the raw material.

6. A method of creating simulated agglutinate particles, comprising:

providing a raw material;

applying a laser that provides localized heating of the raw material to partially melt the raw material; and forming irregular shaped simulated agglutinate particles.

* * * * *